US009221590B2

(12) United States Patent
Renders et al.

(10) Patent No.: US 9,221,590 B2
(45) Date of Patent: Dec. 29, 2015

(54) RESEALABLE PACKAGING FOR FOOD PRODUCTS AND METHOD OF MANUFACTURING

(75) Inventors: Eddy Renders, Westerlo (BE); Peter Looymans, Geel (BE)

(73) Assignee: GENERALE BISCUIT, Rungis (FR)

( * ) Notice: Subject to any disclaimer, the term of this patent is extended or adjusted under 35 U.S.C. 154(b) by 46 days.

(21) Appl. No.: 13/636,616

(22) PCT Filed: Mar. 21, 2011

(86) PCT No.: PCT/EP2011/054250

§ 371 (c)(1),
(2), (4) Date: Sep. 21, 2012

(87) PCT Pub. No.: WO2011/117190

PCT Pub. Date: Sep. 29, 2011

(65) Prior Publication Data

US 2013/0011527 A1 Jan. 10, 2013

(30) Foreign Application Priority Data

Mar. 23, 2010 (EP) ..... 10305289

(51) Int. Cl.
*B65D 33/00* (2006.01)
*B65D 75/58* (2006.01)

(52) U.S. Cl.
CPC ..... *B65D 75/5838* (2013.01)

(58) Field of Classification Search
CPC ..... B65D 77/003; B65D 75/5838; B65D 2575/586; B65D 33/02
USPC ..... 383/203, 205, 207–209, 66, 119, 106; 229/87.05, 87.08, 87.09; 426/110, 122, 426/123
See application file for complete search history.

(56) References Cited

U.S. PATENT DOCUMENTS 401,974 A 4/1889 Smith
811,092 A 1/1906 Roberts (Continued)

FOREIGN PATENT DOCUMENTS

AU 768679 6/2001
AU 2002334419 5/2003

(Continued)

OTHER PUBLICATIONS

International Search Report, PCT/EP2011/054250 dated Jun. 28, 2011.

(Continued)

*Primary Examiner* — Jes F Pascua
(74) *Attorney, Agent, or Firm* — Fitch, Even, Tabin & Flannery LLP

(57) ABSTRACT

Resealable packaging for food products is provided with a flexible container having a top, bottom and side faces, a container aperture having lateral edges extending within the top face, and a flexible closure flap covered of repositionable adhesive on the lateral margins, which are peelable from a closed position in which they adhere around the aperture. The container having a supporting insert including a frame extending along the side faces and having a lower peripheral edge laying against the bottom face of the container. The frame may include foot portions and may have a top peripheral edge situated adjacent the top face and may have head portions between which two top panels extend. The insert covers the inner face of the container in the area on which the lateral margins adhere, to support it during the resealing. A method of manufacturing is also disclosed.

17 Claims, 4 Drawing Sheets

(56) References Cited

U.S. PATENT DOCUMENTS 1,065,012 A 6/1913 Watanabe
1,106,721 A 8/1914 Lewis
1,171,462 A 2/1916 Rice
1,791,352 A 2/1931 Colonnese
1,949,161 A 2/1934 Haug
1,963,639 A 6/1934 Ahlquist
1,978,035 A 10/1934 Thorn
2,033,550 A * 3/1936 Rosen ..... 383/106
2,034,007 A 3/1936 Smith
2,066,495 A 1/1937 Swift
2,079,328 A 5/1937 McBean
2,128,196 A 8/1938 Vogel
2,248,578 A 7/1941 Moore
2,260,064 A * 10/1941 Stokes ..... 53/415
2,320,143 A 5/1943 Johnson
2,321,042 A 6/1943 Preis
2,330,015 A * 9/1943 Stokes ..... 383/109
2,475,236 A 7/1947 Gollab
2,621,788 A 10/1948 Hitchcock
2,554,160 A 5/1951 Von Gunten
2,588,409 A 3/1952 Olsen
2,605,897 A 8/1952 Rundle
2,684,807 A 7/1954 Gerrish
2,719,647 A 10/1955 Freeman
2,823,795 A * 2/1958 Moore ..... 383/106
2,965,224 A 12/1960 Hardwood
3,073,436 A * 1/1963 Burt ..... 229/203
3,080,238 A 3/1963 Kraft et al.
3,127,273 A 3/1964 Monoham
3,179,326 A 4/1965 Underwood et al.
3,186,628 A 6/1965 Rohde
3,187,982 A 6/1965 Underwood et al.
3,217,871 A 11/1965 Lee
3,235,165 A 2/1966 Jackson
3,245,525 A 4/1966 Shoemaker
3,259,303 A 7/1966 Repko
3,260,358 A 7/1966 Gottily et al.
3,272,422 A 9/1966 Miller
3,291,377 A 12/1966 Eggen
3,298,505 A 1/1967 Stephenson
3,311,032 A 3/1967 Lucas
3,326,450 A 6/1967 Langdon
3,331,501 A 7/1967 Stewart, Jr.
3,343,541 A 9/1967 Bellamy, Jr.
3,373,922 A 3/1968 Watts
3,373,926 A 3/1968 Voigtman et al.
3,454,210 A 7/1969 Spiegel et al.
3,471,005 A 10/1969 Sexstone
3,520,401 A 7/1970 Richter
3,528,825 A 9/1970 Doughty
3,570,751 A 3/1971 Trewella
3,595,466 A 7/1971 Rosenburg, Jr.
3,595,468 A 7/1971 Repko
3,618,751 A 11/1971 Rich
3,630,346 A 12/1971 Burnside
3,651,615 A 3/1972 Bohner et al.
3,653,502 A 4/1972 Beaudoin
3,685,720 A 8/1972 Brady
3,687,352 A 8/1972 Kalajian
3,740,238 A 6/1973 Graham
3,757,078 A 9/1973 Conti et al.
3,790,744 A 2/1974 Bowen
3,811,564 A 5/1974 Braber
3,865,302 A 2/1975 Kane
3,885,727 A 5/1975 Gilley
3,905,646 A 9/1975 Brackmann et al.
3,909,582 A 9/1975 Bowen
3,910,410 A 10/1975 Shaw
3,938,659 A 2/1976 Wardwell
3,966,046 A 6/1976 Deutschlander
3,971,506 A 7/1976 Roenna
3,979,050 A 9/1976 Cilia
4,082,216 A * 4/1978 Clarke ..... 229/164.1
4,113,104 A 9/1978 Meyers
4,140,046 A 2/1979 Marbach
4,143,695 A 3/1979 Hoehn
4,156,493 A 5/1979 Julius
4,185,754 A 1/1980 Julius
4,192,420 A 3/1980 Worrell, Sr. et al.
4,192,448 A 3/1980 Porth
4,197,949 A 4/1980 Carlsson
4,210,246 A 7/1980 Kuchenbecker
4,258,876 A 3/1981 Ljungcrantz
4,260,061 A 4/1981 Jacobs
4,273,815 A 6/1981 Gifford et al.
4,285,681 A 8/1981 Walitalo
4,306,367 A 12/1981 Otto
4,337,862 A 7/1982 Suter
4,364,478 A 12/1982 Tuns
4,397,415 A 8/1983 Lisiecki
4,411,365 A 10/1983 Horikawa et al.
4,420,080 A 12/1983 Nakamura
4,428,477 A 1/1984 Cristofolo
4,460,088 A 7/1984 Rugenstein
4,464,154 A 8/1984 Ljungcrantz
4,488,647 A 12/1984 Davis
4,506,488 A 3/1985 Matt et al.
4,518,087 A 5/1985 Goglio
4,538,396 A 9/1985 Nakamura
4,545,844 A 10/1985 Buchanan
4,548,824 A 10/1985 Mitchell et al.
4,548,852 A 10/1985 Mitchell
4,549,063 A 10/1985 Ang et al.
4,550,831 A 11/1985 Whitford
4,552,269 A 11/1985 Chang
4,557,505 A 12/1985 Schaefer et al.
4,570,820 A 2/1986 Murphy
4,572,377 A 2/1986 Beckett
4,608,288 A 8/1986 Spindler
4,610,357 A 9/1986 Nakamura
4,613,046 A 9/1986 Kuchenbecker
4,616,470 A 10/1986 Nakamura
4,625,495 A 12/1986 Holovach
4,638,911 A 1/1987 Prohaska
4,648,509 A 3/1987 Alves
4,651,874 A 3/1987 Nakamura
4,653,250 A 3/1987 Nakamura
4,658,963 A 4/1987 Jud
4,667,453 A 5/1987 Goglio
4,671,453 A 6/1987 Cassidy
4,673,085 A 6/1987 Badouard et al.
4,679,693 A 7/1987 Forman
4,694,960 A 9/1987 Phipps et al.
4,696,404 A 9/1987 Corella
4,709,399 A 11/1987 Sanders
4,723,301 A 2/1988 Chang
4,738,365 A 4/1988 Prater
4,739,879 A 4/1988 Nakamura
4,770,325 A 9/1988 Gordon
4,784,885 A 11/1988 Carespodi
4,790,436 A 12/1988 Nakamura
4,798,295 A 1/1989 Rausing
4,798,296 A 1/1989 Lagerstedt et al.
4,799,594 A 1/1989 Blackman
4,811,848 A 3/1989 Jud
4,818,120 A 4/1989 Addiego
4,838,429 A 6/1989 Fabisiewicz et al.
4,840,270 A 6/1989 Caputo et al.
4,845,470 A 7/1989 Boldt, Jr.
4,848,575 A 7/1989 Nakamura et al.
4,858,780 A 8/1989 Odaka
4,863,064 A 9/1989 Dailey, III
4,865,198 A 9/1989 Butler
4,866,911 A 9/1989 Grindrod et al.
4,874,096 A 10/1989 Tessera-Chiesa
4,876,123 A 10/1989 Rivera et al.
4,889,731 A 12/1989 Williams, Jr.
4,901,505 A 2/1990 Williams, Jr.
4,902,142 A 2/1990 Lammert et al.
4,917,247 A 4/1990 Jud
4,943,439 A 7/1990 Andreas et al.
4,972,953 A 11/1990 Friedman et al.
4,998,666 A 3/1991 Ewan
4,999,081 A 3/1991 Buchanan

(56) References Cited

U.S. PATENT DOCUMENTS

| | | | |
|---|---|---|---|
| 5,000,320 | A | 3/1991 | Kuchenbecker |
| 5,001,325 | A | 3/1991 | Huizinga |
| 5,005,264 | A | 4/1991 | Breen |
| 5,010,231 | A | 4/1991 | Huizinga |
| 5,018,625 | A | 5/1991 | Focke et al. |
| 5,029,712 | A | 7/1991 | O'Brien et al. |
| 5,040,685 | A | 8/1991 | Focke et al. |
| 5,046,621 | A | 9/1991 | Bell |
| 5,048,718 | A | 9/1991 | Nakamura |
| 5,054,619 | A | 10/1991 | Muckenfuhs |
| 5,060,848 | A | 10/1991 | Ewan |
| 5,065,868 | A | 11/1991 | Cornelissen et al. |
| 5,076,439 | A | 12/1991 | Kuchenbecker |
| 5,077,064 | A | 12/1991 | Hustad et al. |
| 5,078,509 | A | 1/1992 | Center et al. |
| 5,082,702 | A | 1/1992 | Alband |
| 5,085,724 | A | 2/1992 | Focke |
| 5,096,113 | A | 3/1992 | Focke |
| 5,100,003 | A | 3/1992 | Jud |
| 5,103,980 | A | 4/1992 | Kuchenbecker |
| 5,108,669 | A | 4/1992 | vanDijk |
| 5,124,388 | A | 6/1992 | Pruett et al. |
| 5,125,211 | A | 6/1992 | O'Brien et al. |
| 5,134,001 | A | 7/1992 | Osgood |
| 5,158,499 | A | 10/1992 | Guckenberger |
| 5,161,350 | A | 11/1992 | Nakamura |
| 5,167,455 | A | 12/1992 | Forman |
| 5,167,974 | A | 12/1992 | Grindrod et al. |
| 5,174,659 | A | 12/1992 | Laske |
| 5,184,771 | A | 2/1993 | Jud et al. |
| 5,190,152 | A | 3/1993 | Smith |
| 5,197,618 | A | 3/1993 | Goth |
| 5,222,422 | A | 6/1993 | Benner, Jr. et al. |
| 5,222,813 | A | 6/1993 | Kopp et al. |
| 5,229,180 | A | 7/1993 | Littmann |
| 5,294,470 | A | 3/1994 | Ewan |
| 5,307,988 | A | 5/1994 | Focke et al. |
| 5,333,735 | A | 8/1994 | Focke et al. |
| 5,344,007 | A | 9/1994 | Nakamura et al. |
| 5,352,466 | A | 10/1994 | Delonis |
| 5,356,068 | A | 10/1994 | Moreno |
| 5,366,087 | A | 11/1994 | Bane |
| 5,371,997 | A | 12/1994 | Kopp et al. |
| 5,374,179 | A | 12/1994 | Swanson |
| 5,375,698 | A | 12/1994 | Ewart et al. |
| 5,381,643 | A | 1/1995 | Kazaitis et al. |
| 5,382,190 | A | 1/1995 | Graves |
| 5,388,757 | A | 2/1995 | Lorenzen |
| 5,405,629 | A | 4/1995 | Marnocha et al. |
| 5,407,070 | A | 4/1995 | Bascos et al. |
| 5,409,115 | A | 4/1995 | Barkhorn |
| 5,409,116 | A | 4/1995 | Aronsen |
| 5,439,102 | A | 8/1995 | Brown |
| 5,454,207 | A | 10/1995 | Storandt |
| 5,460,838 | A | 10/1995 | Wermund |
| 5,460,844 | A | 10/1995 | Gaylor |
| 5,461,845 | A | 10/1995 | Yeager |
| 5,464,092 | A | 11/1995 | Seeley |
| 5,470,015 | A | 11/1995 | Jud |
| 5,489,060 | A | 2/1996 | Godard |
| 5,499,757 | A | 3/1996 | Back |
| 5,503,858 | A | 4/1996 | Reskow |
| 5,505,305 | A | 4/1996 | Scholz et al. |
| 5,515,965 | A | 5/1996 | Boldrini et al. |
| 5,519,982 | A | 5/1996 | Herber et al. |
| 5,520,939 | A | 5/1996 | Wells |
| 5,524,759 | A | 6/1996 | Herzberg et al. |
| 5,531,325 | A | 7/1996 | Deflander et al. |
| 5,538,129 | A | 7/1996 | Chester et al. |
| 5,550,346 | A | 8/1996 | Andriash et al. |
| 5,558,438 | A | 9/1996 | Warr |
| 5,582,342 | A | 12/1996 | Jud |
| 5,582,853 | A | 12/1996 | Marnocha et al. |
| 5,582,887 | A | 12/1996 | Etheredge |
| 5,591,468 | A | 1/1997 | Stockley, III et al. |
| 5,630,308 | A | 5/1997 | Guckenberger |
| 5,633,058 | A | 5/1997 | Hoffer et al. |
| 5,636,732 | A | 6/1997 | Gilels |
| 5,637,369 | A | 6/1997 | Stewart |
| 5,647,100 | A | 7/1997 | Porchia et al. |
| 5,647,506 | A | 7/1997 | Julius |
| 5,664,677 | A | 9/1997 | O'Connor |
| 5,688,394 | A | 11/1997 | McBride, Jr. et al. |
| 5,688,463 | A | 11/1997 | Robichaud et al. |
| 5,702,743 | A | 12/1997 | Wells |
| 5,709,479 | A | 1/1998 | Bell |
| 5,725,311 | A | 3/1998 | Ponsi et al. |
| D394,204 | S | 5/1998 | Seddon |
| D394,605 | S | 5/1998 | Skiba et al. |
| 5,749,657 | A | 5/1998 | May |
| 5,770,283 | A | 6/1998 | Gosselin et al. |
| 5,791,465 | A | 8/1998 | Niki et al. |
| 5,795,604 | A | 8/1998 | Wells et al. |
| 5,819,931 | A | 10/1998 | Boucher et al. |
| 5,820,953 | A | 10/1998 | Beer et al. |
| 5,826,101 | A | 10/1998 | Beck et al. |
| 5,833,368 | A | 11/1998 | Kaufman |
| 5,855,435 | A | 1/1999 | Chiesa |
| 5,862,101 | A | 1/1999 | Haas et al. |
| 5,873,483 | A | 2/1999 | Gortz et al. |
| 5,873,607 | A | 2/1999 | Waggoner |
| 5,882,116 | A | 3/1999 | Backus |
| 5,885,673 | A | 3/1999 | Light et al. |
| 5,906,278 | A | 5/1999 | Ponsi et al. |
| 5,908,246 | A | 6/1999 | Arimura et al. |
| 5,928,749 | A | 7/1999 | Forman |
| 5,938,013 | A | 8/1999 | Palumbo et al. |
| 5,939,156 | A | 8/1999 | Rossi et al. |
| 5,945,145 | A | 8/1999 | Narsutis et al. |
| 5,956,794 | A | 9/1999 | Skiba et al. |
| 5,993,962 | A | 11/1999 | Timm et al. |
| 5,996,797 | A | 12/1999 | Flaig |
| 5,997,177 | A | 12/1999 | Kaufman |
| 6,006,907 | A | 12/1999 | Sato |
| 6,012,572 | A | 1/2000 | Heathcock |
| 6,015,934 | A | 1/2000 | Lee et al. |
| 6,026,953 | A | 2/2000 | Nakamura et al. |
| 6,028,289 | A | 2/2000 | Robichaud et al. |
| 6,029,809 | A | 2/2000 | Skiba et al. |
| 6,056,141 | A | 5/2000 | Navarini et al. |
| 6,060,095 | A | 5/2000 | Scrimager |
| 6,065,591 | A | 5/2000 | Dill et al. |
| 6,066,437 | A | 5/2000 | Kosslinger |
| 6,076,969 | A | 6/2000 | Jaisle et al. |
| 6,077,551 | A | 6/2000 | Scrimager |
| 6,099,682 | A | 8/2000 | Krampe et al. |
| 6,113,271 | A | 9/2000 | Scott et al. |
| 6,125,614 | A | 10/2000 | Jones et al. |
| 6,126,009 | A | 10/2000 | Shiffler et al. |
| 6,126,317 | A | 10/2000 | Anderson et al. |
| 6,152,601 | A | 11/2000 | Johnson |
| 6,164,441 | A | 12/2000 | Guy et al. |
| 6,213,645 | B1 | 4/2001 | Beer |
| 6,228,450 | B1 | 5/2001 | Pedrini |
| D447,054 | S | 8/2001 | Hill |
| 6,273,610 | B1 | 8/2001 | Koyama et al. |
| 6,279,297 | B1 | 8/2001 | Latronico |
| 6,296,884 | B1 | 10/2001 | Okerlund |
| 6,299,355 | B1 | 10/2001 | Schneck |
| 6,309,104 | B1 | 10/2001 | Koch et al. |
| 6,309,105 | B1 | 10/2001 | Palumbo |
| 6,318,894 | B1 | 11/2001 | Derenthal |
| 6,352,364 | B1 | 3/2002 | Mobs |
| 6,364,113 | B1 | 4/2002 | Faasse, Jr. et al. |
| 6,365,255 | B1 | 4/2002 | Kittel et al. |
| 6,383,592 | B1 | 5/2002 | Lowry et al. |
| 6,402,379 | B1 | 6/2002 | Albright |
| 6,420,006 | B1 | 7/2002 | Scott |
| 6,427,420 | B1 | 8/2002 | Olivieri et al. |
| 6,428,208 | B1 | 8/2002 | Addison |
| 6,428,867 | B1 | 8/2002 | Scott et al. |
| 6,446,811 | B1 | 9/2002 | Wilfong, Jr. |
| 6,450,685 | B1 | 9/2002 | Scott |
| 6,457,585 | B1 | 10/2002 | Huffer et al. |

(56) References Cited

U.S. PATENT DOCUMENTS 6,461,043 B1 10/2002 Healy et al.
6,461,708 B1 10/2002 Dronzek
6,471,817 B1 10/2002 Emmert
6,476,743 B1 11/2002 Brown et al.
6,482,867 B1 11/2002 Kimura et al.
6,502,986 B1 1/2003 Bensur et al.
6,517,243 B2 2/2003 Huffer et al.
6,519,918 B2 2/2003 Forman et al.
6,539,691 B2 4/2003 Beer
6,554,134 B1 4/2003 Guibert
6,563,082 B2 5/2003 Terada et al.
6,589,622 B1 7/2003 Scott
6,592,260 B1 7/2003 Randall et al.
6,594,872 B2 7/2003 Cisek
6,612,432 B2 9/2003 Motson
6,616,334 B2 9/2003 Faaborg et al.
6,621,046 B2 9/2003 Kaji
6,669,046 B1 12/2003 Sawada et al.
6,691,886 B1 2/2004 Berndt et al.
6,698,928 B2 3/2004 Miller
6,726,054 B2 4/2004 Fagen et al.
6,726,364 B2 4/2004 Perell et al.
6,746,743 B2 6/2004 Knoerzer et al.
6,750,423 B2 6/2004 Tanaka et al.
6,767,604 B2 7/2004 Muir, Jr. et al.
6,815,634 B2 11/2004 Sonoda et al.
6,852,947 B2 2/2005 Tanaka
6,865,860 B2 3/2005 Arakawa et al.
6,889,483 B2 5/2005 Compton et al.
6,918,532 B2 7/2005 Sierra-Gomez et al.
6,929,400 B2 8/2005 Razeti et al.
6,951,999 B2 10/2005 Monforton et al.
6,969,196 B2 11/2005 Woodham et al.
6,983,875 B2 1/2006 Emmott
7,007,423 B2 3/2006 Andersson et al.
7,021,827 B2 4/2006 Compton et al.
7,032,754 B2 4/2006 Kopecky
7,032,757 B2 4/2006 Richards et al.
7,032,810 B2 4/2006 Benedetti et al.
7,040,810 B2 5/2006 Steele
7,048,441 B2 5/2006 Pape
7,051,877 B2 5/2006 Lin
7,165,888 B2 1/2007 Rodick
7,172,779 B2 2/2007 Castellanos et al.
7,207,718 B2 4/2007 Machacek
7,207,719 B2 4/2007 Marbler et al.
7,213,710 B2 5/2007 Cotert
7,228,968 B1 6/2007 Burgess
7,254,873 B2 8/2007 Stolmeier et al.
7,261,468 B2 8/2007 Schneider et al.
7,262,335 B2 8/2007 Motsch et al.
7,302,783 B2 12/2007 Cotert
7,344,744 B2 3/2008 Sierra-Gomez et al.
7,344,755 B2 3/2008 Beaman et al.
7,350,688 B2 4/2008 Sierra-Gomez et al.
7,351,458 B2 4/2008 Leighton
7,352,591 B2 4/2008 Sugahara
7,371,008 B2 5/2008 Bonenfant
7,404,487 B2 7/2008 Kumakura et al.
7,422,142 B2 9/2008 Arippol
7,470,062 B2 12/2008 Moteki et al.
7,475,781 B2 1/2009 Kobayashi et al.
7,516,599 B2 4/2009 Doll et al.
7,527,189 B2 5/2009 Billig
7,533,773 B2 5/2009 Aldridge et al.
7,600,641 B2 10/2009 Burgess
7,703,602 B2 4/2010 Saito et al.
7,708,463 B2 5/2010 Sampaio Camacho
7,717,620 B2 5/2010 Hebert et al.
7,740,923 B2 6/2010 Exner et al.
7,744,517 B2 6/2010 Bonenfant
7,758,484 B2 7/2010 Peterson
7,858,901 B2 12/2010 Krishnan et al.
7,963,413 B2 6/2011 Sierra-Gomez et al.
7,971,718 B2 7/2011 Aldridge
8,002,171 B2 8/2011 Ryan et al.
8,002,941 B2 8/2011 Exner et al.
8,029,428 B2 10/2011 Selle et al.
8,038,349 B2 10/2011 Andersson et al.
8,114,451 B2 2/2012 Sierra-Gomez et al.
8,181,784 B2 5/2012 Bouthiette
8,240,546 B2 8/2012 Friebe et al.
8,308,363 B2 11/2012 Vogt et al.
8,408,792 B2 4/2013 Cole et al.
8,506,165 B2 8/2013 Shinozaki
8,763,890 B2 7/2014 Clark
8,920,030 B2 12/2014 McSweeney
8,951,591 B2 2/2015 Vogt
2001/0000480 A1 4/2001 Stagg et al.
2002/0000441 A1 1/2002 Redmond
2002/0068668 A1 6/2002 Chow et al.
2003/0019780 A1 1/2003 Parodi et al.
2003/0047695 A1 3/2003 Zik et al.
2003/0051440 A1 3/2003 Chow et al.
2003/0127352 A1 7/2003 Buschkiel et al.
2003/0170357 A1 9/2003 Garwood
2003/0183637 A1 10/2003 Zappa et al.
2003/0217946 A1 11/2003 Hsu
2004/0035719 A1 2/2004 Ebbers et al.
2004/0060974 A1 4/2004 Dacey
2004/0091184 A1 5/2004 Miller
2004/0112010 A1 6/2004 Richards et al.
2004/0150221 A1 8/2004 Brown
2004/0180118 A1 9/2004 Renger et al.
2005/0000965 A1 1/2005 Boardman
2005/0084186 A1 4/2005 Caris
2005/0117819 A1 6/2005 Kingsford et al.
2005/0247764 A1 11/2005 Sierra-Gomez et al.
2005/0276525 A1 12/2005 Hebert et al.
2005/0276885 A1 12/2005 Bennett
2005/0284776 A1 12/2005 Kobayashi et al.
2006/0066096 A1 3/2006 Kan
2006/0124494 A1 6/2006 Clark, Jr. et al.
2006/0171611 A1 8/2006 Rapparini
2006/0199717 A1 9/2006 Marbler et al.
2006/0251342 A1 11/2006 Forman
2006/0257056 A1 11/2006 Miyake et al.
2006/0283750 A1 12/2006 Villars
2006/0285779 A1 12/2006 Golas
2007/0023435 A1 2/2007 Sierra-Gomez et al.
2007/0023436 A1 2/2007 Sierra-Gomez et al.
2007/0095709 A1 5/2007 Saito
2007/0140600 A1 6/2007 Nowak et al.
2007/0269142 A1 11/2007 Tyska et al.
2008/0013869 A1 1/2008 Forman
2008/0031555 A1 2/2008 Roberts
2008/0034713 A1 2/2008 Kohl
2008/0037911 A1 2/2008 Cole et al.
2008/0041750 A1 2/2008 Kohlweyer
2008/0053861 A1 3/2008 Mellin
2008/0060751 A1 3/2008 Arrindell
2008/0063324 A1 3/2008 Bernard et al.
2008/0063759 A1 3/2008 Raymond
2008/0063760 A1 3/2008 Raymond et al.
2008/0101733 A1 5/2008 Fenn-Barrabass
2008/0131035 A1 6/2008 Rogers
2008/0135428 A1 6/2008 Tallier
2008/0152264 A1 6/2008 Pokusa et al.
2008/0156861 A1 7/2008 Sierra-Gomez et al.
2008/0159666 A1 7/2008 Exner et al.
2008/0199109 A1 8/2008 Rutzinger
2008/0203141 A1 8/2008 Friebe et al.
2008/0214376 A1 9/2008 Bonenfant
2008/0240627 A1 10/2008 Cole et al.
2008/0273821 A1 11/2008 Doll
2008/0292225 A1 11/2008 Dayrit et al.
2009/0001143 A1 1/2009 Cowan et al.
2009/0014491 A1 1/2009 Fuisz et al.
2009/0022431 A1 1/2009 Conner
2009/0028472 A1 1/2009 Andersson et al.
2009/0053372 A1 2/2009 Hambrick et al.
2009/0074333 A1 3/2009 Griebel et al.
2009/0097786 A1 4/2009 Goglio et al.
2009/0161995 A1 6/2009 Henderson et al.

(56) References Cited

U.S. PATENT DOCUMENTS

| | | | |
|---|---|---|---|
| 2009/0190866 | A1 | 7/2009 | Hughes |
| 2009/0211938 | A1 | 8/2009 | Aldridge |
| 2009/0226117 | A1 | 9/2009 | Davis et al. |
| 2009/0273179 | A1 | 11/2009 | Scott et al. |
| 2009/0301903 | A1 | 12/2009 | Andersson |
| 2010/0002963 | A1 | 1/2010 | Holbert et al. |
| 2010/0018974 | A1 | 1/2010 | Lyzenga et al. |
| 2010/0019022 | A1 | 1/2010 | Ryan et al. |
| 2010/0111453 | A1 | 5/2010 | Dierl |
| 2010/0113241 | A1 | 5/2010 | Hebert et al. |
| 2010/0147724 | A1 | 6/2010 | Mitra-Shah |
| 2010/0172604 | A1 | 7/2010 | Andersson et al. |
| 2010/0226598 | A1 | 9/2010 | Stoeppelmann |
| 2010/0230303 | A1 | 9/2010 | Buse et al. |
| 2010/0230411 | A9 | 9/2010 | Sierra-Gomez et al. |
| 2010/0278454 | A1 | 11/2010 | Huffer |
| 2010/0303391 | A9 | 12/2010 | Cole et al. |
| 2011/0049158 | A1 | 3/2011 | Bouthiette |
| 2011/0127319 | A1 | 6/2011 | Golden |
| 2011/0132976 | A1 | 6/2011 | Drewnowski et al. |
| 2011/0147443 | A1 | 6/2011 | Igo |
| 2011/0204056 | A1 | 8/2011 | Veternik et al. |
| 2011/0253718 | A1 | 10/2011 | Sierra-Gomez et al. |
| 2012/0125932 | A1 | 5/2012 | Sierra-Gomez et al. |
| 2013/0004626 | A1 | 1/2013 | Renders et al. |
| 2013/0064477 | A1 | 3/2013 | Vogt et al. |
| 2013/0114918 | A1 | 5/2013 | Lyzenga et al. |
| 2014/0185965 | A1 | 7/2014 | Lyzenga |
| 2014/0270597 | A1 | 9/2014 | Friedman |
| 2015/0016756 | A1 | 1/2015 | Down |
| 2015/0021219 | A1 | 1/2015 | SeyfferthDeOliveira |

FOREIGN PATENT DOCUMENTS

| | | | | |
|---|---|---|---|---|
| AU | 768679 | | 12/2003 | |
| AU | 2004295316 | | 6/2005 | |
| AU | 2005254459 | | 12/2005 | |
| BR | DI55008852 | F | 11/2001 | |
| BR | DI62020307 | F | 4/2003 | |
| BR | D168046367 | F | 10/2009 | |
| CN | 1224396 | A | 7/1999 | |
| CN | 1781819 | A | 6/2006 | |
| DE | 1848370 | | 3/1962 | |
| DE | 1848870 | | 3/1962 | |
| DE | 3700988 | A1 | 7/1988 | |
| DE | 3835721 | A1 | 5/1990 | |
| DE | 9003401 | | 5/1990 | |
| DE | 9005297 | | 8/1990 | |
| DE | 90140656 | | 4/1991 | |
| DE | 4134567 | | 1/1993 | |
| DE | 4241423 | | 6/1994 | |
| DE | 19738411 | | 4/1999 | |
| DE | 19822328 | | 11/1999 | |
| DE | 202004012301 | | 12/2004 | |
| DE | 20122333 | | 3/2005 | |
| DE | 202007005487 | | 6/2007 | |
| DE | 102007030267 | | 1/2009 | |
| DE | 10 2010 019 867 | A1 * | 9/2011 | |
| DE | 102010019867 | A1 | 9/2011 | |
| EP | 85289 | | 8/1983 | |
| EP | 0307924 | A2 | 3/1989 | |
| EP | 0085289 | | 8/1989 | |
| EP | 388310 | | 9/1990 | |
| EP | 408831 | A1 | 1/1991 | |
| EP | 447636 | | 9/1991 | |
| EP | 0447636 | | 9/1991 | |
| EP | 474981 | | 3/1992 | |
| EP | 488967 | | 6/1992 | |
| EP | 546369 | | 6/1993 | |
| EP | 608909 | | 8/1994 | |
| EP | 613824 | | 9/1994 | |
| EP | 629561 | | 12/1994 | |
| EP | 661154 | | 7/1995 | |
| EP | 667828 | | 8/1995 | |
| EP | 669204 | | 8/1995 | |
| EP | 744357 | | 11/1996 | |
| EP | 752375 | | 1/1997 | |
| EP | 758993 | | 2/1997 | |
| EP | 905048 | | 3/1999 | |
| EP | 796208 | | 1/2000 | |
| EP | 1046594 | | 10/2000 | |
| EP | 1056066 | | 11/2000 | |
| EP | 1086906 | | 3/2001 | |
| EP | 1136379 | | 9/2001 | |
| EP | 1288139 | | 3/2003 | |
| EP | 1318081 | A1 | 6/2003 | |
| EP | 1350741 | | 8/2003 | |
| EP | 1375380 | | 1/2004 | |
| EP | 1382543 | | 1/2004 | |
| EP | 1437311 | | 7/2004 | |
| EP | 1449789 | | 8/2004 | |
| EP | 1457424 | | 9/2004 | |
| EP | 1468936 | | 10/2004 | |
| EP | 1477425 | | 11/2004 | |
| EP | 1488936 | | 12/2004 | |
| EP | 1608567 | | 12/2005 | |
| EP | 1609737 | | 12/2005 | |
| EP | 1619137 | | 1/2006 | |
| EP | 1637472 | | 3/2006 | |
| EP | 1697230 | | 9/2006 | |
| EP | 1712468 | | 10/2006 | |
| EP | 1755980 | | 2/2007 | |
| EP | 1760006 | | 3/2007 | |
| EP | 1770025 | | 4/2007 | |
| EP | 1846306 | | 10/2007 | |
| EP | 1858776 | | 11/2007 | |
| EP | 1873082 | A1 | 1/2008 | |
| EP | 1908696 | | 4/2008 | |
| EP | 1939107 | | 7/2008 | |
| EP | 1975081 | | 10/2008 | |
| EP | 1712488 | | 12/2008 | |
| EP | 2033910 | | 3/2009 | |
| EP | 2189506 | | 5/2010 | |
| FR | 1327914 | | 4/1963 | |
| FR | 2674509 | | 10/1992 | |
| FR | 2693988 | | 1/1994 | |
| FR | 2766794 | | 2/1999 | |
| FR | 2783512 | | 3/2000 | |
| GB | 1107200 | | 3/1968 | |
| GB | 2171077 | | 8/1986 | |
| GB | 2266513 | | 11/1993 | |
| GB | 2276095 | | 9/1994 | |
| GB | 2335652 | A | 9/1999 | |
| GB | 2339187 | A | 1/2000 | |
| JP | 57163658 | | 10/1982 | |
| JP | S5822411 | B2 | 5/1983 | |
| JP | 6080405 | | 5/1985 | |
| JP | 62171479 | | 10/1987 | |
| JP | 63022370 | | 1/1988 | |
| JP | 01167084 | A | 6/1989 | |
| JP | 01167084 | A * | 6/1989 | ..... B65D 83/08 |
| JP | 01226579 | A | 9/1989 | |
| JP | 01226579 | A * | 9/1989 | ..... B65D 83/08 |
| JP | 01267182 | A | 10/1989 | |
| JP | 01267182 | A * | 10/1989 | ..... B65D 83/08 |
| JP | H11343468 | | 12/1990 | |
| JP | H0581083 | | 11/1993 | |
| JP | 09142551 | A * | 6/1997 | ..... B65D 83/08 |
| JP | 09142551 | A | 6/1997 | |
| JP | 9150872 | | 6/1997 | |
| JP | 9156677 | | 6/1997 | |
| JP | H09156677 | A | 6/1997 | |
| JP | 1059441 | | 3/1998 | |
| JP | 10129685 | | 5/1998 | |
| JP | 10152179 | | 9/1998 | |
| JP | 10120016 | | 12/1998 | |
| JP | 11198977 | | 7/1999 | |
| JP | 2000335542 | | 12/2000 | |
| JP | 2000335542 | A | 12/2000 | |
| JP | 2001114357 | | 4/2001 | |
| JP | 2001301807 | | 10/2001 | |
| JP | 2002002805 | A * | 1/2002 | ..... B65D 77/30 |
| JP | 2002104550 | A | 4/2002 | |

(56) References Cited

FOREIGN PATENT DOCUMENTS

| | | | |
|---|---|---|---|
| JP | 200326224 | | 1/2003 |
| JP | 2003072774 | | 3/2003 |
| JP | 2003137314 | | 5/2003 |
| JP | 2005015015 | | 1/2005 |
| JP | 200602767 | | 2/2006 |
| JP | 2006062712 | | 3/2006 |
| JP | 2006137445 | A | 6/2006 |
| JP | 2007045434 | | 2/2007 |
| JP | 2009166870 | | 7/2009 |
| NZ | 555274 | | 12/2008 |
| WO | 8606350 | | 11/1986 |
| WO | 9104920 | | 4/1991 |
| WO | 9411270 | | 5/1994 |
| WO | 9411270 | A1 | 5/1994 |
| WO | 9532902 | | 2/1995 |
| WO | 9725200 | | 7/1997 |
| WO | 0064755 | | 11/2000 |
| WO | 0140073 | | 6/2001 |
| WO | 0140073 | A1 | 6/2001 |
| WO | 02064365 | | 8/2002 |
| WO | 02066341 | | 8/2002 |
| WO | 03013976 | | 2/2003 |
| WO | 03035504 | | 5/2003 |
| WO | 03037727 | | 5/2003 |
| WO | 03059776 | | 7/2003 |
| WO | 2004087527 | | 10/2004 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110886 | | 11/2005 |
| WO | 2005120989 | | 12/2005 |
| WO | 2005123535 | | 12/2005 |
| WO | 2006055128 | | 5/2006 |
| WO | 2006080405 | | 8/2006 |
| WO | 2006108614 | | 10/2006 |
| WO | 2007079071 | A1 | 7/2007 |
| WO | 2007090419 | | 8/2007 |
| WO | 2008051813 | | 5/2008 |
| WO | 2008062159 | | 5/2008 |
| WO | 2008074060 | | 6/2008 |
| WO | 2008108969 | | 9/2008 |
| WO | 2008115693 | | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010051146 | | 5/2010 |
| WO | 2010080810 | | 7/2010 |
| WO | 2010084336 | | 7/2010 |
| WO | 2010088492 | | 8/2010 |
| WO | 2010114879 | | 10/2010 |
| WO | 2010149996 | | 12/2010 |
| WO | 2011004156 | | 1/2011 |
| WO | 2011121337 | | 10/2011 |
| WO | 2011146616 | | 11/2011 |
| WO | 2011146627 | | 11/2011 |
| WO | 2011146658 | | 11/2011 |
| WO | 2012098412 | | 7/2012 |

OTHER PUBLICATIONS

"Cheese Range", Mintel gnpd, Jan. 26, 2001, Mintel Publishing. cited by other.
"Elite Edam Cheese", Mintel gnpd, Dec. 3, 2001, Mintel Publishing, cited by other.
"Margin." Merriam-Webster Online Dictionary. 2010. Merriam-Webster [online], retrieved on May 6, 2010, Retrieved from the Internet:URL:&It;http://www.merriarn-webster.com/dictionary/margin>.
"New Easy Peel Cheese Packaging", Mintel gnpd, Aug. 10, 2001, Mintel Publishing. cited by other.
"New on the Shelf-Produce Instruction and Packaging Trends", Circle Reader Service Card No. 93, Aug. 1998, Baking & Snack. cited by other.
"Soft Bread Sticks", Mintel gnpd, Mar. 20, 1998, Mintel Publishing. cited by other.
English Translation of BR DI 5500885-2 F, published Nov. 20, 2001.
English Translation of BR DI 6202030-7 F, published Apr. 15, 2003.
English Translation of BR DI 6804638-7 F, published Oct. 20, 2009.
English Translation of JP 1998-152179 published on Sep. 6, 1998.
English Translation of JP 2001-114357 published on Apr. 24, 2001.
English Translation of JP 2003-26224 published Jan. 29, 2003.
English Translation of JP H09-156677, published Jun. 17, 1995.
English Translation of JP Official Notice of Rejection mailed on Feb. 14, 2012 in JP Appl. No. 2009-172352.
English Translation of JP Official Notice of Rejection mailed on Jan. 29, 2013 in JP Appl. No. 2008-087152, 5 pages.
English Translation of JP S60-80405, published Aug. 5, 1985.
European Packaging Pack Report, NR, 5 Mai 2001 and partial translation thereof, 6 pages.
European Search Report 06118142.6 dated May 3, 2007, citing DE90140656.
European Search Report, EP10305289 citing DE1848870U.
Fuji Packaging GmbH Fachpack brochure, Oct. 11-12, 2001, 2 pages.
Giant Baby Wipes package, item No. 80203-91, resealable package having die cut-out portions (tabs) which remain affixed to the top of the package after label is withdrawn from the top, whereby tamper evidence is indicated by a misalignment of thedie cut-.
Machinery Update, Mar./Apr. 2002, pp. 56-62.
Machinery Update, Sep./Oct. 2001, pp. 46-47.
Patent Abstracts of Japan, vol. 1997 No. 10, Oct. 31, 1997 and JP09156677 A (Fuji Seal Co. Ltd.) (Jul. 6, 1997) abstract in English and 7 figures, cited by other.
Reclosure system lengthens food life, Packaging News PPMA Preview, Sep. 2001, p. 40. cited by other.
Reseal-it. [Homepage of Macfarlane Group] [Online] 2005, Available at: http//www.real-it.se [accessed Mar. 14, 2005]. cited by other.
Defendants' Unenforceability Contentions Pursuant to LPR 2.3, dated May 17, 2013, 13 pages.
Defendants' LPR 2.3 Initial Non-Infringement Contentions Exhibit A, dated May 17, 2013, 39 pages.
Defendants' Invalidity Contentions Pursuant to LPR 2.3, dated May 17, 2013, 23 pages.
Defendants' Invalidity Contentions—Exhibit A-1, dated May 17, 2013, 55 pages.
Defendants' Invalidity Contentions—Exhibit A-2, dated May 17, 2013, 35 pages.
Defendants' Invalidity Contentions—Exhibit A-3, dated May 17, 2013, 34 pages.
Defendants' Invalidity Contentions—Exhibit A-4, dated May 17, 2013, 35 pages.
Defendants' Invalidity Contentions—Exhibit A-5, dated May 17, 2013, 39 pages.
Defendants' Initial Non-Infringement Contentions Pursuant to LPR 2.3(a), dated May 17, 2013, 7 pages.
Defendants' Answer, Affirmative Defenses, and Counterclaims Responsive to Complaint, dated Apr. 5, 2012, 25 pages.
Plaintiff's Complaint for Patent Infringement, dated Jan. 16, 2013, 7 pages.
Plaintiff's Answer to Counterclaims of Defendant, dated Apr. 26, 2013, 20 pages.
Plaintiff's Initial Response to Defendant's Initial Invalidity Contentions, dated May 31, 2013, 20 pages.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-4, dated May 31, 2013, 17 pages.
Global Brands' LPR 2.5 Initial Response to Defendants' Initial Invalidity Contentions Chart Ex. A-5, dated May 31, 2013, 14 pages.

(56) References Cited

OTHER PUBLICATIONS

"Wall's Bacon—A Sizzling Success Story," and the Grocer: "When sealed delivers," the second page of which bears a date of Aug. 21, 1999.
Defendants' Final Invalidity Contentions—Exhibit A-1, dated Sep. 27, 2013, 55 pages.
Defendants' Final Invalidity Contentions—Exhibit A-2, dated Sep. 27, 2013, 35 pages.
Defendants' Final Invalidity Contentions—Exhibit A-3, dated Sep. 27, 2013, 34 pages.
Defendants' Final Invalidity Contentions—Exhibit A-4, dated Sep. 27, 2013, 35 pages.
Defendants' Final Invalidity Contentions—Exhibit B-1, dated Sep. 27, 2013, 135 pages.
Defendants' Final Invalidity Contentions—Exhibit B-2, dated Sep. 27, 2013, 64 pages.
Defendants' Final Invalidity Contentions—Exhibit B-3, dated Sep. 27, 2013, 140 pages.
Defendants' Final Invalidity Contentions—Exhibit B-4, dated Sep. 27, 2013, 273 pages.
Defendants' Final Invalidity Contentions—Exhibit B-5, dated Sep. 27, 2013, 146 pages.
Defendants' Final Invalidity Contentions—Exhibit B-6, dated Sep. 27, 2013, 226 pages.
Defendants' Final Invalidity Contentions Pursuant to LPR 3.1, dated Sep. 27, 2013, 22 pages.
Defendants' Final Unenforceability Contentions Pursuant to LPR 3.1, dated Sep. 27, 2013, 14 pages.
English Translation of JP H09-158677 published on Jun. 17. 1997, 2 pages.
Machine Translation of DE 202007005487, published Jun. 14, 2007, provided by Espacenet, 3 pages.
Machine Translation of DE 9014065, published Mar. 19, 2009, provided by Espacenet, 9 pages.
Opposition to EP 1679269 filed by Awapatent AB, Heisingborg, Sweden. May 2, 2012.
Opposition to EP 1679269 filed by Bahlse GmbH and Co. KG, Apr. 30, 2012.
Partial European Search Report for Appl. No. EP 11155570 dated Jun. 12, 2011, citing DE 9003401 and DE 9005297, 9 pages.
European Search Report, EP 10305289 citing DE 1848870U, 3 pages.
Machine translation of CN 1781819A published Jun. 7, 2006 from google.com/patents; 13 pages, accessed Jun. 5, 2014.
English Translation of Japanese Unexamined Application Publication No. H9-156677, published Jul. 17, 1997; 6 pages.
Kellogg's Reply Claim Construction Brief, dated Jan. 24, 2014, 19 pages.
Kellogg's Opening Claim Construction Brief, dated Dec. 13, 2013, 30 pages.
Defendants' Supplemental Memorandum of Law Regarding Additional Claim Construction Authority Requested by the Court, dated Feb. 28, 2014, 13 pages.
Kellogg's Response to Plaintiff's Surreply Claim Construction Brief Pursuant to Docket No. 98, dated Feb. 28, 2014, 9 pages.
Plaintiff Intercontinental Great Brands LLC's Submission of Authority Pursuant to Docket No. 98, dated Feb. 28, 2014, 11 pages.
Plaintiff Intercontinental Great Brands LLC's Responsive Claim Construction Brief Pursuant to LPR 4.2, dated Feb. 10, 2014, 27 pages.
U.S. District Court for the Northern District of Illinois, Eastern Division Memorandum Opinion and Order, dated Sep. 22, 2014, 12 pages.
Plaintiff Intercontinental Great Brands LLC\s Surreply Claim Construction Brief Pursuant to Docket No. 98, dated Feb. 21, 2014, 6 pages.
Additional Exhibits from Declaration of James Lukas Jr. filed Mar. 26, 2015, 73 pages.
Declaration of James J. Lukas, Jr. in Support of Defendants' Motion for Summary Judgment with Exhibits, Part 1 dated Mar. 23, 2015, 277 pages.
Declaration of James J. Lukas, Jr. in Support of Defendants' Opposition to plaintiffs Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Consolidated Memorandum in Support of Motion for Summary Judgment (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Local Rule 56.1 Statement of Material Facts in Support of Motion for Summary Judgment (redacted), dated Mar. 23, 2015, 75 pages.
Defendants' LR 56.1 (b) (3) (C) Statement of Additional Material Facts in Support.Of Their Opposition to Plaintiff's Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 and/or 103, dated Mar. 23, 2015, 4 pages.
Defendants' Motion to Compel Discovery, dated Oct. 13, 2014, 3 pages.
Defendants' Response to Plaintiffs Local Rule 56.1 Statement of Material Facts in Support of Plaintiffs Motions for Summary Judgment, dated May 28, 2015, 108 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiffs.Consolidated Memorandum of Law in Support of Plaintiffs Cross-Motion for Summary Judgment (redacted), dated May 8, 2015, 300 pages.
Exhibits, part 3, to Declaration of James J. Lukas, Jr. In Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted), dated May 8, 2015, 136 pages.
Exhibits from Defendants' Memorandum in Support of Their Motion to Compel Discovery, dated Oct. 13, 2014, 68 pages.

(56) References Cited

OTHER PUBLICATIONS

Exhibits from Plaintiff's Memorandum of Law in Opposition to Defendants' Motion to Compel Discovery, Oct. 15, 2014, 78 pages.
Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiffs LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Machine Translation of EP 1449789 description. Translated on Jun. 13, 2015, 18 pages.
Defendant's Local Rule 56.1 Statement of Material Facts in Support of Motion for Summary Judgment, dated Mar. 23, 2015, 75 pages.
English Translation of JP2006137445 filed by Shimomura, published Jun. 1, 2006, translation provided by the USPTO in U.S. Appl. No. 13/698,567.
U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the USPTO in U.S. Appl. No. 11/193,614.

* cited by examiner

RESEALABLE PACKAGING FOR FOOD PRODUCTS AND METHOD OF MANUFACTURING

CROSS-REFERENCE TO RELATED APPLICATIONS

This application is a national phase application of International Application No. PCT/EP2011/054250, filed Mar. 21, 2011, designating the United States and claiming priority to European Patent Application No. 10305289.0, filed Mar. 23, 2010, each of which are incorporated by reference herein in its entirety.

FIELD

The present invention relates to packaging for food products, such as crackers, biscuits, cookies, confectionery, chocolate or other snacks, provided with a resealable opening and preferably a wide opening.

BACKGROUND

There is consumer demand for food product packaging having a closure which enables a consumer to withdraw only a portion of the product therein and to reclose the package in order to preserve the freshness of the remaining product during a period which may vary from hours to few a days. In particular, with dry food products like crackers, the ambient humidity may quickly alter their crispiness.

Packages with resealable openings are known in the art, as shown, for example, in the document EP1637472 A1, which discloses a label that can be reapplied over a slit shaped opening formed by tearing off a portion of the double layer wrapping at the first opening.

However, with that kind of packaging, the accessibility of the food products and the tightness of the reclosed package opening may need improvement, notably when a substantial portion of the food product has been withdrawn.

Indeed, with packaging that comprises a layer of corrugated card wrapped tightly around a stack of biscuits, the biscuits remaining at the package ends have to be displaced up toward the slit shaped opening to be accessible. Such displacement deforms the package, and then, the closure flap cannot be reapplied over the opening in a sufficiently tight manner to preserve the freshness.

Moreover, this corrugated layer of the wrapper is not rigid in the radial direction by itself. If no biscuits remain in the interior region, the wrapper tends to collapse when the user pulls down the closure flap on the remainder of the wrapper film in an attempt to readhere the closure flap with the repositionable adhesive. Consequently, it is particularly difficult to obtain a high-quality resealing feature for food products contained in bulk in such packaging.

SUMMARY

In one aspect, the present invention improves the resealability and the convenience of use of the package, while minimizing costs and manufacturing waste.

The present disclosure includes a resealable package for food product of the above-mentioned type, characterized by a flexible container that contains a supporting insert comprising a frame extending along the side faces of the container, said frame having a lower peripheral edge laying against the bottom face of the container. The lower peripheral edge may include foot portions. The frame also having a top peripheral edge that may be situated adjacent the top face of the container. In one aspect, the top peripheral edge may include head portions between which at least two top panels extend just below the top face. In another aspect, said supporting insert covers at least the inner face of the flexible container in the area on which the lateral margins of the closure flap adheres, so that it supports said flexible container during the resealing of the closure flap.

The supporting insert provides a support within the flexible container that prevents it from collapsing when the closure flap is gently pressed on it, notably on the top face. Note that the base portion and the free end margin of the closure flap need not be supported by the insert, even though that is not excluded. In fact, it appears that supporting the area on which the lateral margins of the closure flap adhere is helpful, and could be sufficient to obtain satisfactory resealing.

The supporting insert also helps maintain the cross-sectional profile of the flexible container over the longitudinal portions receiving the lateral margins, even though the supporting insert may have no panel facing the bottom face. The frame structure of the supporting insert has end walls connecting longitudinal walls, and consequently prevents the longitudinal walls from moving closer or leaning inward. Such an effect would not be obtained with an insert merely made of a corrugated cardboard sheet bend in a U-shaped form. In one embodiment, the frame of the supporting insert does not to tightly wrap the food products, which may even be contained in bulk, so they can move more or less freely within the container and toward the container aperture.

It appears that the quantity of material needed for the supporting insert remains acceptable in view of the obtained advantages. Additionally, the manufacturing and the filling process are compatible with existing facilities for packaging food products directly in seam-sealed flexible film.

In the various embodiments of the invention, one or many of the following features can be used.

The supporting insert does not extend within the container aperture, in order to prevent adhesion of the margins to the insert.

The top peripheral edge of the frame has lower portions facing the base portion and the free end of the closure flap, said lower portions being situated below the head portions and at a distance from the container aperture. This configuration saves material and does not hinder resealability.

Each of the top panels has a free edge extending along a lateral side of the container aperture and at a distance thereof substantially shorter than the width of the lateral margins, in order to support most of the lateral margins' width.

The top panels have four sides, three of them being linked to head portions of the frame. This arrangement significantly improves the vertical load which can be supported by the insert.

The lower peripheral free edge of the frame defines the widest inner cross section of said frame, at least for an initial configuration. Thanks to that feature the food products can be inserted through the lower peripheral edge without interfering with the top panels.

The lower peripheral edge of the frame comprises movable portions in addition to the foot portions. Said movable portions enable it to closely fit the shape of the products.

The supporting insert is made of double face corrugated cardboard. Other materials can be used, but a double face corrugated cardboard offers a particularly good compromise between the optimal rigidity, the quantity of material needed, and its price.

The supporting insert is made from a single sheet-like insert blank that is assembled only by mutual engagement of tabs. Such an insert (excluding glue) is advantageous for food products and relatively inexpensive to manufacture despite the fact it may require additional development time before production.

The flexible container extends along a longitudinal axis between the opposite side end-faces having a sealing seam, and the closure flap extends in a direction perpendicular to the longitudinal axis, the container aperture having a width along the longitudinal axis which is comprised between 60% and 90% of the top face length, and preferably about 70%. These features offer a particularly convenient package for users that also has good resealability.

The supporting insert contains a stack of flat food products having a longitudinal widest outer section which substantially corresponds to the inner cross section of the lower peripheral edge of the frame, at least in an initial configuration. Consequently, there is no particular need for filling the supporting insert even for stacked food products.

The invention also relates to a method of manufacturing the resealable packaging having any of the above features. The manufacturing method comprises the steps of:

providing a flexible film with the closure flap;

providing the supporting insert;

filing the supporting insert with the food products through the lower peripheral edge thereof;

folding the flexible film around the filled supporting insert; and then sealing the flexible film longitudinally and at cut ends to form the sealed flexible container.

In a preferred embodiment of the method, the food products are stacked horizontally on a conveyor, and the supporting insert is moved in a transverse direction with respect to the axis of the stack, in order to pass said stack through the lower peripheral edge of the frame.

According to another preferred feature of method, the supporting insert is filled in a location which is offset from a transportation path of the flexible film.

BRIEF DESCRIPTION OF THE DRAWINGS

Further advantages and characteristic features will become apparent from the following description of the embodiments, given by way of example, with reference to the drawings, in which.

DETAILED DESCRIPTION

The same numeral references are used in the figures to designate identical or similar elements.

Figure 1:
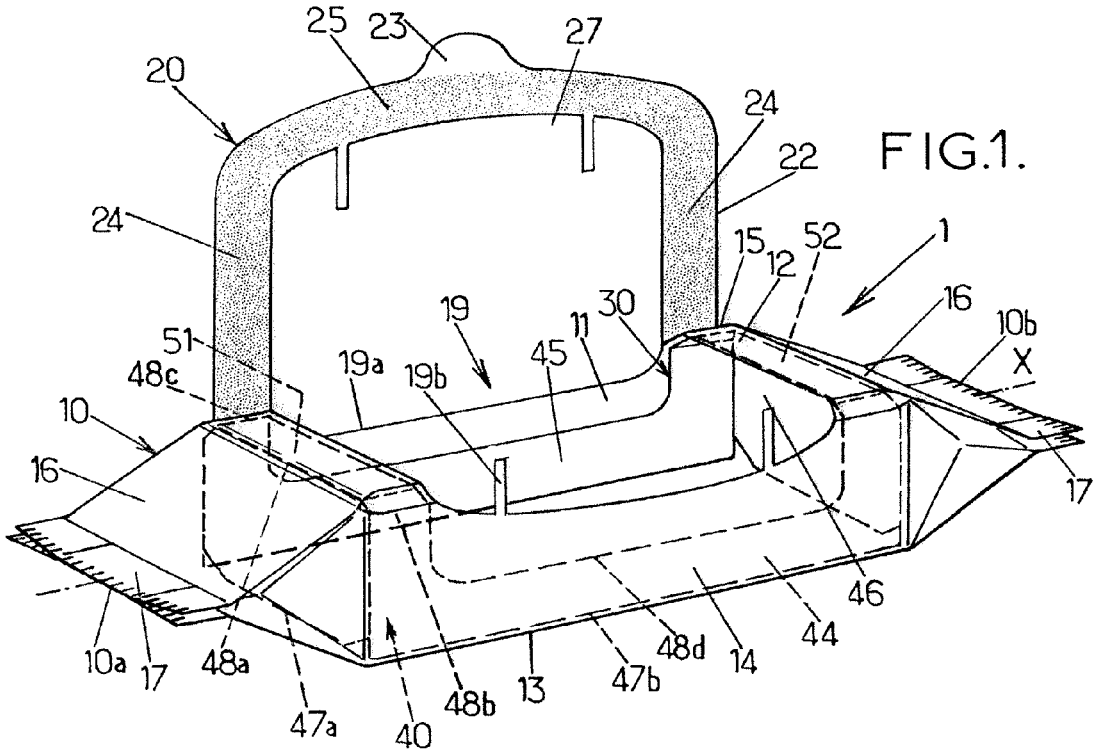
FIG. 1 is a schematic perspective view of a food package according to the invention having a closure flap in an open position and a supporting insert represented in dashed lines.
Figure 6:
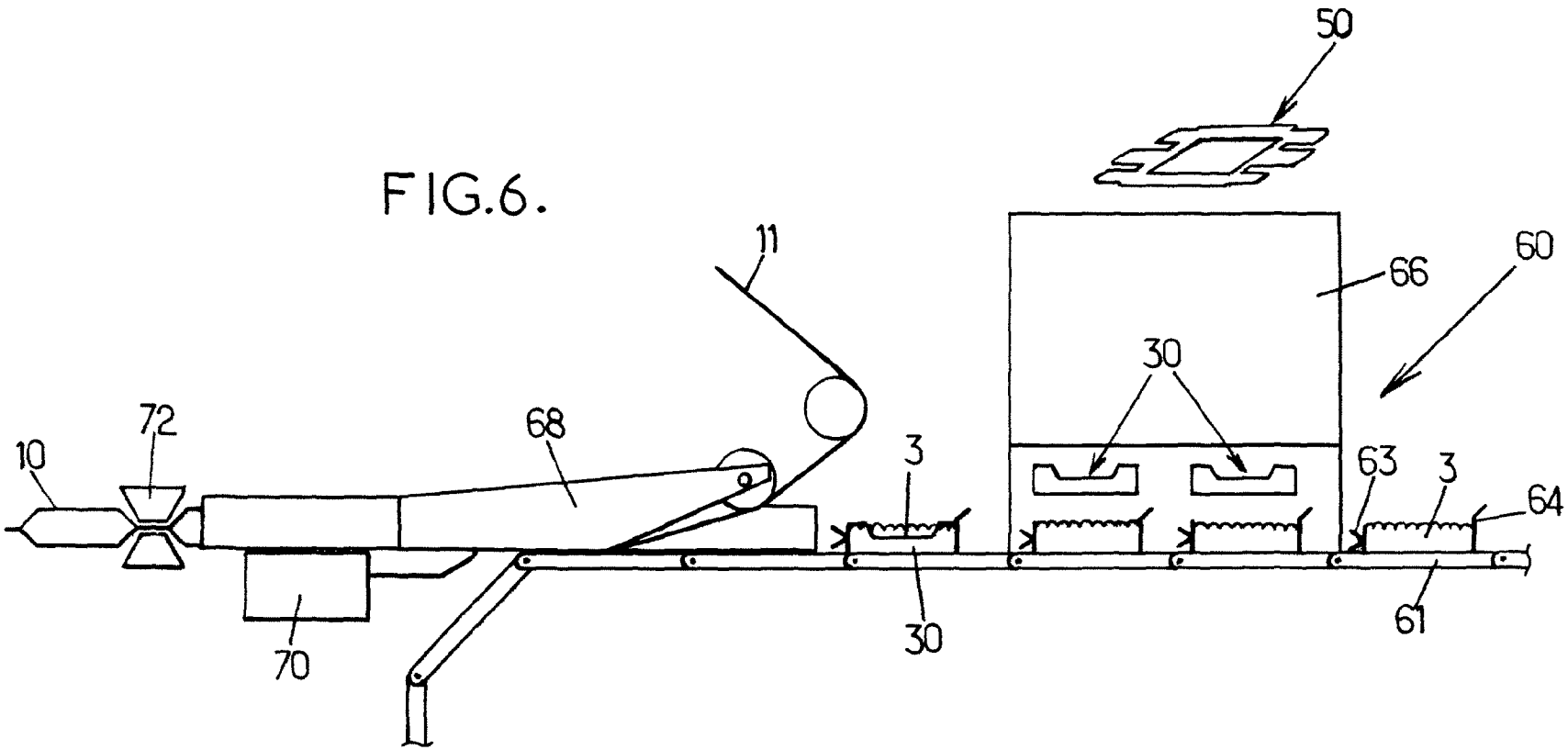
FIG. 6 is a schematic representation of the manufacturing process of the packaging of FIG. 1.

FIG. 1 illustrates a package 1 designed to containing food products 3, which are schematically represented in FIG. 6.

In this embodiment, the food products are crackers of generally rectangular shape. More precisely, the shape may be generally octagonal with a shape corresponding to a rectangle with the corners cut off. The individual food products may be arranged adjacent to each other to form a stack. The food products are not necessarily rectangular and they could be more or less round or polygonal. The packaging is suitable for various kinds of dry food products, like biscuits, cookies, and slices of bread. The food products are not necessarily arranged to form a stack. The packaging also is suitable for smaller products in bulk, like any kind of snackers or sweets, as it will appear from the description below.

The package 1 comprises a container 10 made of flexible film 11 so that the container is flexible.

In one embodiment, container 10 has an elongated shape extending along a longitudinal axis X between two longitudinal ends (10*a*, 10*b*). The container 10 presents a top face 12, a bottom face 13, and side faces. In one embodiment, the side faces comprise a front side face 14, a rear side face 15 and two opposite lateral faces 16 at the longitudinal ends (10*a*, 10*b*).

Figure 2:
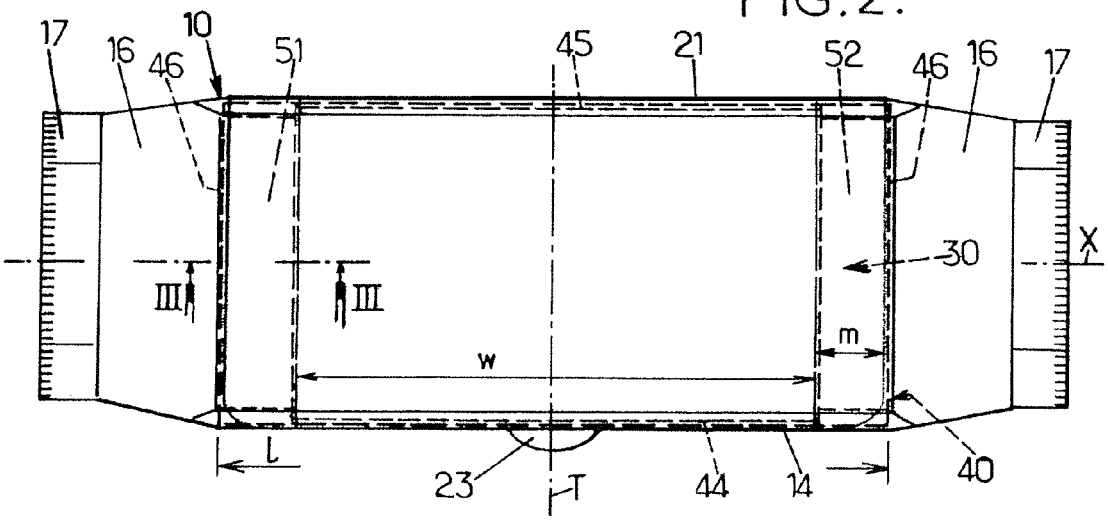
FIG. 2 is an elevation view of the package of the FIG. 1 in which the closure flap is in the closed position.

The outside of the flexible container 10 is printed with decorative and informational graphics, not represented on FIGS. 1 and 2 for the sake of clarity.

The flexible container 10 is not, however, a parallelepiped. The lateral side faces 16 can present a pyramidal shape, like in the preferred embodiment, terminated by transversal sealing seams 17 made by a heat sealing bond. The flexible container 10 does not wrap the stacked food products in a tight manner. Consequently, the flexible container 10 may not have a cross section profile with exact angles, but a somewhat more rounded profile around the food product. In fact, in the embodiment represented, the flexible container is a slug. It has no sharp edges and has somewhat bevelled longitudinal edges. For bulk products, the flexible container may further differ from a parallelepiped. The cross section profile is not necessary a rectangle, but could be any kind of polygon, even a triangle. In that case, the top face is particularly narrow and the front and rear faces are not parallel. As used herein, the expression "side faces" must be interpreted as meaning the surfaces of the container 10 visible on an orthogonal side view, whereas the top and bottom faces (12, 13) are the complementary surfaces.

The flexible film 11 is made of plastic, such as polypropylene (PP) having a thickness of about 40 micrometers in the preferred embodiments. However the film can be made of another material, such as, for example, polyester (PE) or polypropylene (PP) laminate and its thickness can vary substantially depending of the resistance and various properties needed for the food contained. The thickness can notably vary within a range of 30 to 90 micrometers.

To form a tubular body, the flexible film is sealed along a longitudinal sealing seam not visible on figures, which extends through the bottom face 13 up to the end sealing seams 17.

The flexible container 10 has an aperture 19 designed to enable withdraw of at least one product 3 there through. The container aperture 19 is located on the top face 12. In the preferred embodiment, the aperture 19 extends transversally through the top face 12 and onto an upper portion of the front and rear side faces (14, 15) in order to facilitate the withdraw of food products.

The aperture 19 as a width w, measured along the longitudinal axis X, which represents a major portion of the top face 12 length l, as best seen on FIG. 2.

In the embodiment represented, the aperture width w is about 90 mm representing about 70% of the length l of the top face 12. The aperture width w could represent a shorter portion of the top face and could be reduced to a slit shaped aperture. However, a wide aperture, representing at least 60% of the top face length l, is much more convenient for the user and enables using the opened packaging as a tray laying on a table.

The width w can be greater than 70%, notably for longer packages, but, preferably no more than 90% of the length l of the top face 12. In fact, as it will appear below, the end portions of the container top face 12 preferably remains uncut for facilitating the resealing after the first opening.

As it can be seen in FIG. 1, the lateral edges of the aperture 19 extending transversally through the top face 12 are rectilinear. The front edge of the aperture 19 extending longitudinally on the front side face 14 is arc shaped.

The aperture 19 is delimited by a continuous cut out line 19*a*, so that no portion of the flexible container 10 has to be torn off at the first opening of the packaging, at least in the peripheral area of the aperture 19 so that area is not subjected to permanent deformation of the flexible film. However, the cut line can include few indentations defining narrow strips 19*b*, possibly with an end not cut, which extend toward the aperture centre to form integrity indicating means as described in the document EP1975081 A1. Such narrow strips 19*b* do not create significant permanent deformation of the peripheral area.

The package 1 further comprises a closure flap 20 provided on the outer side of the flexible container 10. The closure flap 20 comprises a base portion 21 indicated in FIG. 2, a movable portion 22 designed to cover the container aperture 19 and a peripheral area thereof in a closed position, and a gripping member 23 at the opposite longitudinal end of the base portion 21.

The closure flap 20 is considered as extending from the base on portion 21 to the gripping member 23, even if it could have a width w longer than its length, in order to cover the wide aperture 19. The directional axis of extension of the closure flap, indicated by the axis T in FIG. 2, extends in a transverse direction with respect to the longitudinal axis X. This direction of the closure flap avoids interference with end sealing seams 17 and this is convenient for withdrawing food products.

The closure flap 20 is made of flexible material and preferably made of a plastic film. In the preferred embodiment, the flexible material is a transparent film of PP which has a thickness about 50 micrometers.

The closure flap 20 is covered of a repositionable adhesive, notably a pressure sensitive adhesive (PSA), except on the tab forming the gripping means 23. The layer of adhesive is uniform and thin, like that disposed on a label.

The base portion 21 of the flap adheres to the rear side face 15 over a medium portion thereof situated below the end of the aperture 19. The base portion remains attached to the flexible container 10, at least during normal use. For example, peeling stop cuts may be created through the base portion or a layer of permanent adhesive may be used, or a hot sealing area disposed between the base portion 21 and the flexible container 10.

The movable portion 22 is wider than the container aperture 19 in order to provide two lateral margins 24 and a free end margin 25 covered with the repositionable adhesive, indicated by dots in FIG. 1, covers a peripheral area of the aperture 19. The peripheral area can be covered by a portion of the base portion 21 to complete the U-shaped margins (24, 25) of the movable portion 22. However, it is important, at least before the first opening, that the closure flap 20 uniformly and tightly covers the peripheral area of the container aperture 19, since this aperture is delimited by a cut out line through the container 10. By way of example, a margin 24 of 15 mm wide, as indicated by m on FIG. 2, provides a sufficient sealing.

The central area of the movable portion 22, which corresponds in shape and position to the aperture 19 in the closed position, does not have exposed adhesive disposed thereon. Several configurations may prevent the central area from having exposed adhesive and being sticky, like keeping the central area free of adhesive. However, it is more advantageous to cover the central area with a panel 27 cut out from the flexible film 11 of the container.

Figure 5:
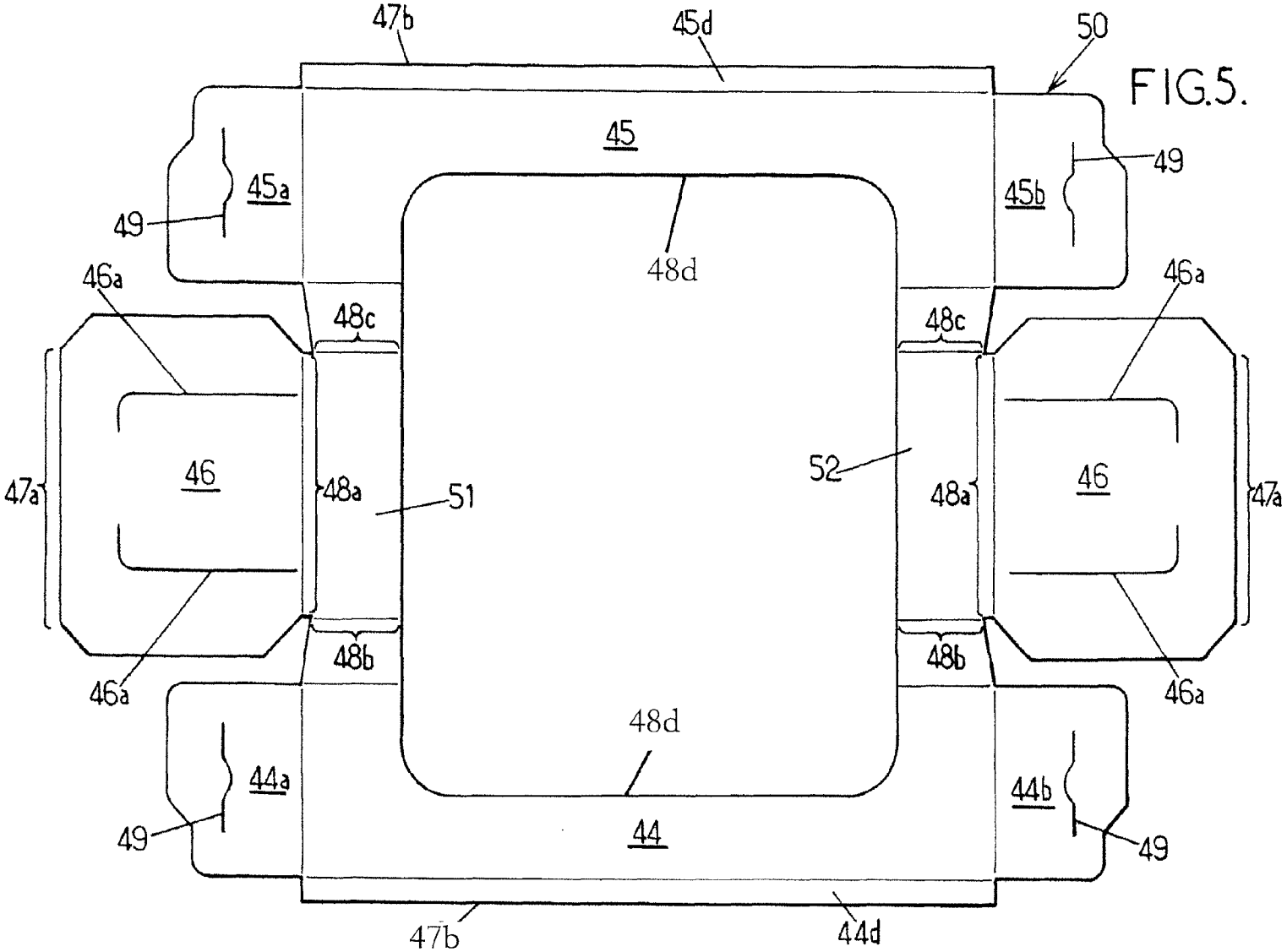
FIG. 5 is a top view of an insert blank for forming the supporting insert of FIG. 1.

In one aspect, a supporting insert 30 represented in dashed lines at FIGS. 1 and 2, and in a blank configuration at FIG. 5, is provided.

The supporting insert 30 comprises a frame 40, i.e., a rectangular, or polygonal, member forming a peripheral wall delimitating free passage. The frame 40 extends along the side faces (14, 15, 16) of the container 10, so that it has a rectangular profile visible in dashed lines in FIG. 2. The frame 40 has a front 44, a rear 45 longitudinal walls linked by end walls 46.

The flexible container 10 can wrap the frame in a tight manner or with a slight clearance. However, a loose fit of the frame 40 within the flexible container 10 is preferably avoided to prevent the frame from moving inside the container.

Figure 3:
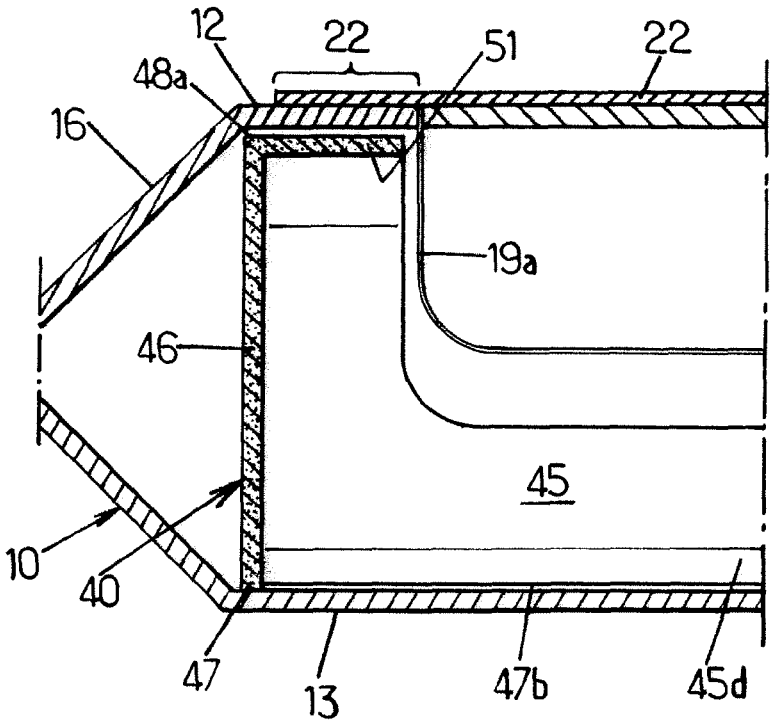
FIG. 3 is a partial cross-section view along the line III-III of the FIG. 2.

The frame 40 has a peripheral lower edge 47. The lower peripheral edge 47 can be disclosed in a single horizontal plane adjacent a bottom face 13, along its whole circumference. However, in the preferred embodiment, the peripheral lower edge includes some portions, called foot portions 47*a*, situated at a lower level than the remaining portions of that lower edge. The foot portions 47*a* are situated at the lower edge of the end walls 46 and come in contact with the bottom face 13 of the flexible container as it can be seen in FIG. 3, when the package rests on a table in the configuration of FIG. 1. The lower peripheral edge 47 is a free edge, since the supporting insert 30 has no bottom wall.

The lower peripheral edge 47 also compromises longitudinal portions indicated by 47*b* which correspond to the bottom edge of the longitudinal walls (14, 15).

The frame 40 has a top peripheral edge 48 that corresponds to the highest points of the frame 40. The top peripheral edge 48 comprises head portions at a highest level which are situated just below the top face 12 of the flexible container, possibly in contact with that top face. The top peripheral edge 48 of the frame 40 has lower portions 48*d* facing the base portion 21 and the free end of the closure flap 20, said lower portions 48*d* being situated below the head portions and at a distance from the container aperture.

More particularly, in the embodiment represented, each longitudinal end of the frame comprises a U-shaped head portions formed by the edge 48*a* of the end wall 46 and two adjacent short portions (48*b*, 48*c*) corresponding to the top edge of the longitudinal walls (14, 15).

The supporting insert 30 further comprises two top panels (51, 52). Each top panel (51, 52) extends between the head portions (48*a*, 48*b* and 48*c*), so that they extend just below the top face 12 of the flexible container 10.

The top panels (51, 52) cover the inner face of flexible container 10 over the area on which the lateral margins 24 of the closure flap 20 adhere when the gripping member 23 is pulled down.

The supporting insert 30 supports the flexible container 10 in the area where the margins (24, 25) are gently pressed in order to adhere the movable portion 22 with a remainder of the package.

The supporting insert 30 prevents the formation of wrinkles or waves in the flexible film of the container 10 due to the presence of the frame 40 and panels (51, 52) against the inner face of the flexible film 11 and also by preserving the cross sectional profile of the flexible container 10 and avoiding formation loops on its flexible faces.

For supporting the area facing the lateral margins 24, it is possible to provide narrow top panels linked only to opposite head portions, like head portions 48*b* and 48*c* of the front and rear side walls (44, 45).

In the preferred embodiment, the top panels (51, 52) are linked on a third side to the head portion 48*a* of the end wall 46. That feature significantly increases the capacity of the top panels (51, 52) to support a load. The fact that the end walls 46 form both the foot portions 47*a* and the head portions 48*a*, also improve the capability of the supporting insert 30 to bear a load.

Preferably, the top panels (51, 52) do not extend within the container aperture 19 in order to prevent adhesion between the margins (24, 25) and the supporting insert 30 which may be made of material much more adherent to the repositionable adhesive than the flexible film 11.

In the preferred embodiment, the free edge of the top panel (51, 52) extends along the corresponding lateral side of the container aperture 19 at a distance substantially shorter than the width m of the lateral margins 24.

In this embodiment, the top panels (51, 52) are designed to have a free edge at a distance of 2 or 3 mm of the aperture 19 while the margins have a width m about 15 mm.

Linking the top panels (51, 52) along three of their sides enables a sloping panel adjacent to the top portions (48*b*, 48*c*) of front or rear longitudinal walls (44, 45), despite the fact that that sloping panels tend, by themselves, to reduce the capability to support a vertical load.

The supporting insert 30 must be inexpensive to manufacture in order to limit the additional costs, which increase due to the resealable opening in the packaging. It is also preferable that it can be recycled. But the supporting insert must be rigid enough, to support the load applied by a user to adhere the lateral margins 24 when a user pulls down the closure flap 20. A corrugated card or cardboard material is inexpensive. However, a double face corrugated card or cardboard also is highly preferable for withstanding a vertical load. In fact a single face corrugated card or cardboard is too flexible in the direction transverse to the flutes to support any load. More particularly, the corrugated card or cardboard has an important number of flutes per foot, like the F-flute type, and is relatively thin, with a thickness about 1.3 mm. Other materials can be used, like card board or synthetic resin. It could be preferable to make the supporting insert from cast film, like a cast polypropylene (CPP), in order to reduce the thickness of the walls.

The supporting insert 30 is made from a card, cardboard, or foil material into which a blank 50, represented at FIG. 5, is cut out. The blank 50 consists of a single piece which is erected by folding and mutual engagement of tabs to form the supporting insert 30, without any further fixation means like glue or staple. More particularly, the end walls 46 are attached to the front and rear longitudinal walls (44, 45) to form a peripheral frame by virtue of tabs (44*a*, 44*b*, 45*a*, 45*b*) which are inserted through slits 46*a* of the end walls 46. The tabs are engaged with the end walls 46 by a dent defined by a slit 47, which is passed over the edge of the slit 46*a*. The folding lines are preformed by clinking the blank 50 along corresponding lines indicated on the FIG. 5.

Figure 4:
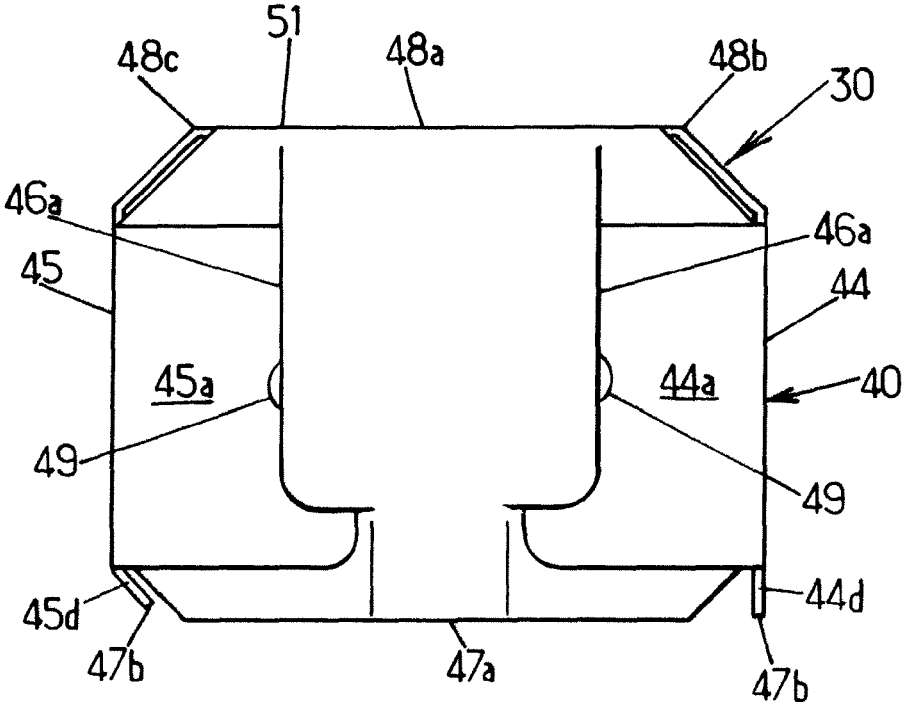
FIG. 4 is a side view of the supporting insert of FIG. 1.

The front and rear longitudinal walls have a hinged panel (44*d*, 45*d*) adjacent to the lower peripheral edge 47. Then, the lower peripheral edge of the frame 40 has movable portions 47*b*. The movable portions 47*b* can move from an initial configuration, visible on the right of FIG. 4, in which they extend in the plane of the longitudinal wall (44, 45), to a packaging configuration in which they slop toward the foot portions 47*a*.

In the initial configuration, the lower peripheral edge 47 defines a widest inner cross section of the frame 40 which enables a stack of biscuits to pass there through. If the stack of biscuits has a rectangular shape with bevelled corners, like in the preferred embodiment, the hinged panels (44*d*, 45*d*) enable the insert to surround them in a pretty close manner. Then, the food product shape can be directly recognized from the outside.

Various manufacturing processes are available for manufacturing and filling a package according to the disclosure. However, a preferred method for manufacturing the packaging is schematically represented at FIG. 6.

The food products 3 are arranged to form horizontal stacks on a chain conveyor 61. Each stack is maintained between a front stop 63 and a rear stop 64. The front and rear stops (63, 64) have upper ends diverting from the products 3. The front stop 63 is resilient, made of a metal band, by way of example, to exert a light pressure on the stack and for enabling some variations of the stack length.

The manufacturing facilities further include an automatic blank erecting machine 66, a flexible film transportation path 67, a flexible film folding device 68, a longitudinal sealing device 70, and a transverse cutting and sealing device 72.

The insert blanks 50 are fed to the erecting machine 66, which sets them into the three-dimensional shape of the supporting insert 30. The machine 66 also places an erected supporting insert over each horizontal stack of food products 3 by inserting the end walls 46 between the stack and the stops (63, 64). The lower peripheral edge 47 advantageously defines the wider inner cross section of the frame 40 during this step in order to fill the supporting insert 30 easily. In other words, the insert 30 is in an initial configuration if the frame comprises hinged panels (44*d*, 45*d*).

The filling is done by a relative movement of translation between the stack of products 3 and the insert 30 in a direction perpendicular with regard to the stack axis. In the described embodiment, the supporting insert 30 is moved downwardly over the stack. Nevertheless, other relative movements are possible.

It should be noted that the supporting insert 30 is filled in a location that is offset from the flexible film transportation path 67 and not above the flexible film as usual for manufacturing seam sealed flexible containers. Thus, the risk that crumbs fall on the flexible film 11 is limited.

Linking the top panels (51, 52) along three of their sides enables a sloping panel adjacent to the top portions (48*b*, 48*c*) of front or rear longitudinal walls (44, 45), despite the fact that that sloping panels tend, by themselves, to reduce the capability to support a vertical load.

The flexible film 11 previously printed and provided with closure flaps 20, is transported in a flat configuration to the folding device 68 which bends the film upward to create a tubular profile around the supporting insert 30. During this step the hinged panels (44*d*, 45*d*) are moved against the products 3 to follow their outer profile. Then, the longitudinal edges of the film 11 are welded together by the longitudinal sealing device 70. The next device 72 forms the transverse seams 17, which close the flexible containers 10 and perform a transverse cut to obtain individual packages.

The detailed description here above is not limitative and various modifications can be adopted in addition to those mentioned above. The possible modifications depend notably on the kind and the shape of the food product to be contained within the packaging.

Any reference sign in the following claims should not be construed as limiting the claim. It will be obvious that the use of the verb "to compromise" and its conjugations does not exclude the presence of any other elements besides those defined in any claim. The word "a" or "an" preceding an element does not exclude the presence of a plurality of such elements.

The invention claimed is:

1. A resealable package for food products, comprising:

a flexible container having a top face, a bottom face and side faces, a container aperture wide enough for withdrawing a food product and having lateral edges extending at least within the top face, a flexible closure flap extending from a base portion designed to remain bonded to the container to a gripping member, and provided therebetween with a movable portion covered of repositionable adhesive on lateral margins and on a free end margin which are peelable from a closed position in which said lateral and free end margins adhere to a peripheral area of the container aperture, wherein the flexible container contains a supporting insert comprising a frame extending along the side faces of the container and having top panels, end walls, and respective front and rear panels, the end walls having foot portions, said frame having a lower peripheral edge laying against the bottom face at least along the foot portions of the end walls, and having a top peripheral edge situated below the top face of the container at least in head portions between which the top panels extend just below the top face, said supporting insert covering at least an inner face of the flexible container in the peripheral area on which the lateral margins of the closure flap adhere, so that it supports said flexible container during the resealing of the closure flap;

wherein each of the top panels has a free edge extending along, and separated from, a lateral side of the container aperture; and wherein the top peripheral edge has lower portions formed from the front and rear panels and facing the base portion and the free end margin of the closure flap, said lower portions being substantially separated from the container aperture.

2. The resealable packaging of claim 1, wherein the supporting insert does not extend within the container aperture.

3. The resealable package of claim 1, wherein the lower portions are situated below the head portions and at a distance from the container aperture.

4. The resealable package of claim 1, wherein the free edges of the top panels are substantially shorter than the width (m) of the lateral margins.

5. The resealable package of claim 1, wherein the top panels have four sides, three of them being linked to head portions of the frame.

6. The resealable package of claim 1, wherein the lower peripheral free edge of the frame defines the widest inner cross section of said frame, at least for an initial configuration.

7. The resealable package of claim 1, wherein at least one of the front, rear, and end walls includes a hinged panel forming longitudinal, movable portions and the lower peripheral edge of the frame further comprises the longitudinal, movable portions in addition of the foot portions.

8. The resealable package of claim 1, wherein the supporting insert is made of double face corrugated board.

9. The resealable package of claim 1, wherein the supporting insert is made from a single sheet like insert blank assembled by mutual engagement of tabs.

10. The resealable package of claim 1, wherein the flexible container extends along a longitudinal axis (X) between opposite side end faces having a sealing seam, and wherein the closure flap extends in a transversal direction (T) with respect to said longitudinal axis (X), the container aperture having width (w) along the longitudinal axis which is comprised between 60% and 90% of the top face length (I).

11. The resealable package of claim 10 wherein the width of the container aperture is about 70% of the top face length.

12. The resealable package of claim 1, wherein the supporting insert contains a stack of a flat food products having a longitudinal widest outer section which substantially corresponds to the inner cross section of the lower peripheral edge of the frame, at least for an initial configuration.

13. The resealable package of claim 1 wherein the frame further comprises sloping panels connecting the top panels and the front and rear walls.

14. The resealable package of claim 1 where the top panels do not extend into the container aperture.

15. The resealable package of claim 1 wherein the frame has no bottom wall and the lower peripheral edge thereof is a free edge.

16. The resealable package of claim 1, wherein the lower portions are separated from the container aperture by a greater distance than the distance by which the free edges of the top panels are separated from the container aperture.

17. The resealable package of claim 1, wherein the flexible container extends along a longitudinal axis (X) between opposite side end faces having a sealing seam, the sealing seams being separated from the end walls.

* * * * *